United States Patent [19]

Finsterwald et al.

[11] Patent Number: 4,909,713

[45] Date of Patent: Mar. 20, 1990

[54] PERISTALTIC PUMP

[75] Inventors: P. Michael Finsterwald, Colorado Springs; George J. Eilers, Evergreen, both of Colo.

[73] Assignee: Cobe Laboratories, Inc., Lakewood, Colo.

[21] Appl. No.: 860,539

[22] Filed: May 7, 1986

[51] Int. Cl.[4] ..... F04B 43/12

[52] U.S. Cl. ..... 417/477

[58] Field of Search ..... 417/474–477

[56] References Cited

U.S. PATENT DOCUMENTS

| | | | |
|---|---|---|---|
| 3,396,669 | 8/1968 | Everett | 417/476 |
| 3,737,251 | 6/1973 | Berman et al. | 417/475 X |
| 3,737,256 | 6/1973 | Devries | 417/477 |
| 3,832,096 | 8/1974 | Gelfand | 417/475 |
| 4,392,794 | 7/1983 | Foxcroft | 417/477 X |
| 4,472,117 | 9/1984 | Wenstrup | 417/477 |
| 4,530,647 | 7/1985 | Uno | 417/477 |
| 4,586,882 | 5/1986 | Tseng | 417/477 |
| 4,861,242 | 8/1989 | Finsterwald | 417/477 |

FOREIGN PATENT DOCUMENTS 1528964 6/1969 Fed. Rep. of Germany .

*Primary Examiner*—Leonard E. Smith
*Assistant Examiner*—Eugene L. Szczecina, Jr.

[57] ABSTRACT

A peristaltic pump comprising a race having an internal surface for supporting a flexible tube in a tube pumping region, and a rotor rotatably mounted about a rotor axis and carrying rollers that travel in a circular path adjacent to the tube pumping region, the rollers having a large diameter central portion between smaller diameter portions to cause the tube to be self-aligning at the central portion. Also disclosed are a cover mounted on the race for movement in a direction parallel to the rotation axis between a loading position spaced from the race sufficiently to permit insertion of the tube through a tube insertion opening into a tube mounting region and an operational position in which the tube insertion opening is closed; and self-loading a tube into a peristaltic pump via rollers having a small diameter end portion and an adjacent larger diameter portion.

16 Claims, 2 Drawing Sheets

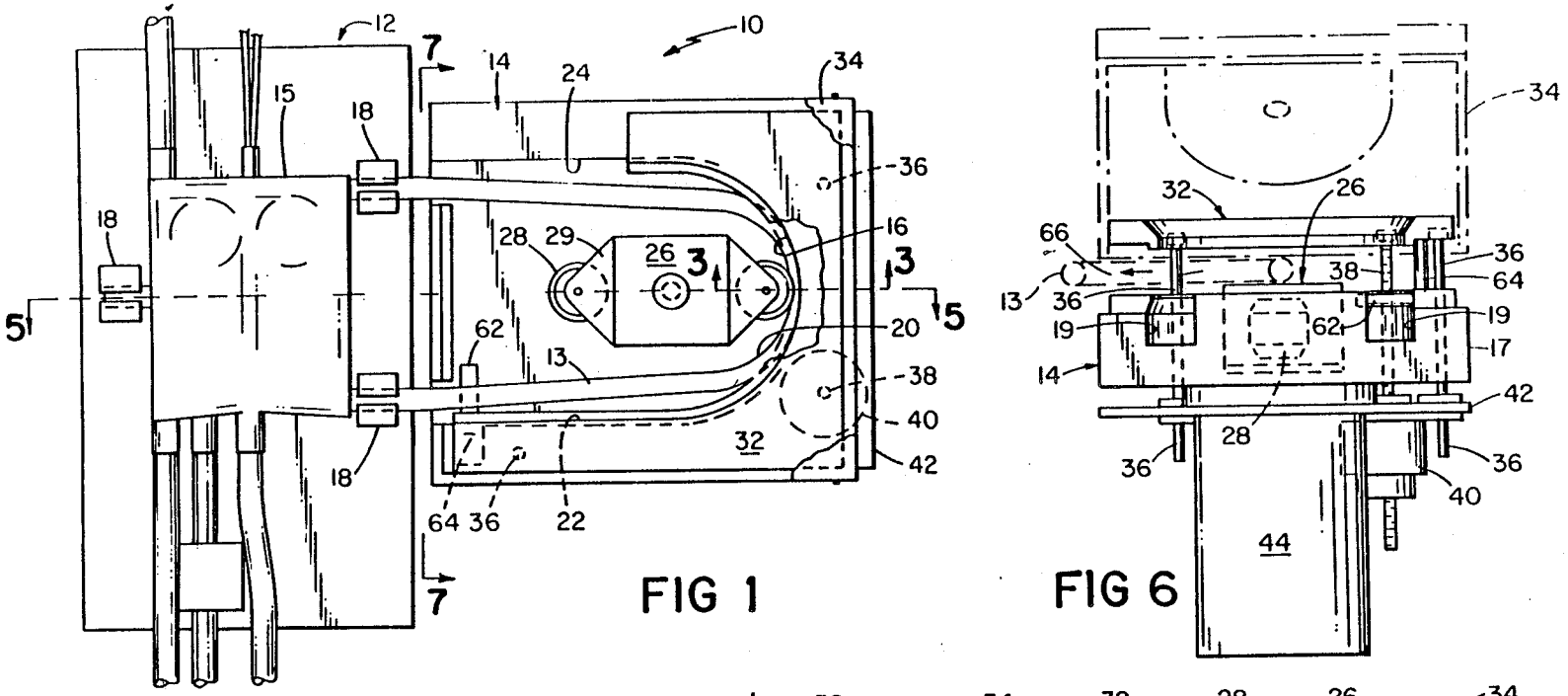
FIG 1
FIG 6
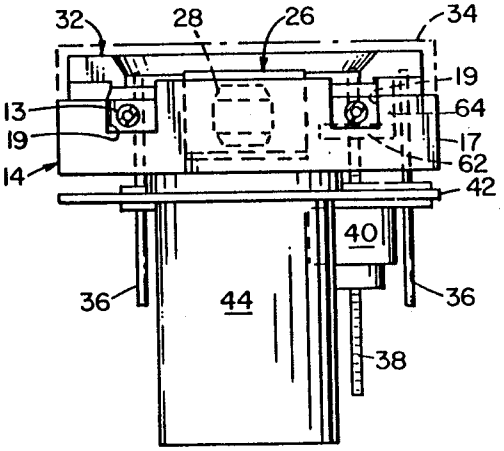
FIG 7
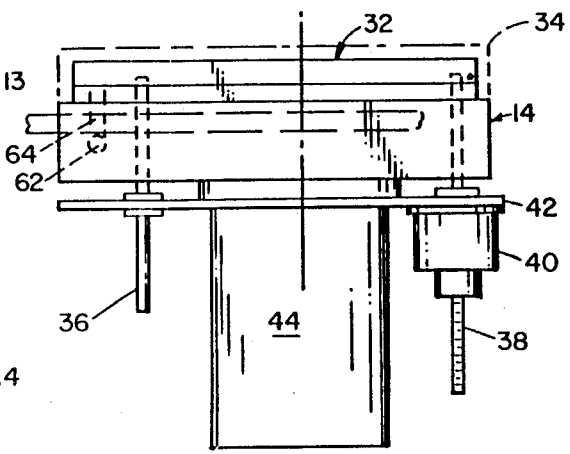
FIG 2
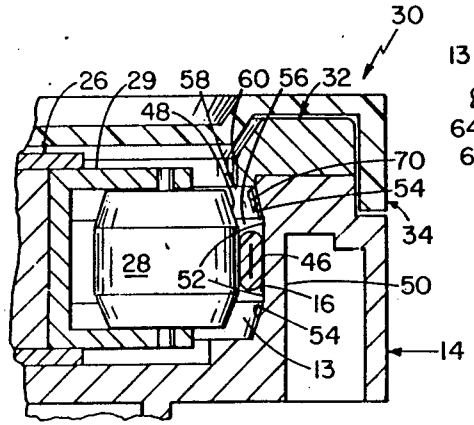
FIG 3

PERISTALTIC PUMP

FIELD OF THE INVENTION

The invention relates to peristaltic pumps.

BACKGROUND OF THE INVENTION

In peristaltic pumps a flexible tube is compressed between rollers that are carried by a rotor and travel along a circular path and a race with a surface adjacent to and concentric with the path of the rollers. As the occluded portion of the tube is advanced, the fluid in front of it is forced to travel through the tube. In some pumps the tube is maintained in proper position on the rollers through the use of guides that are on the rotor and move with respect to the tube.

SUMMARY OF THE INVENTION

In one aspect the invention features a peristaltic pump including a roller that has a large diameter central portion between smaller diameter portions to cause the flexible tube to be self-aligning at the central portion during operation. In preferred embodiments the race against which the roller compresses the tube has large and small diameter portions matching those of the roller; the large diameter portion of the roller is cylindrical, and the smaller diameter portions are conical; and the rollers are spring-biased radially outward.

In another aspect, the invention features a peristaltic pump that has a cover mounted for movement parallel to the rotation axis between a loading position that is spaced from the race to provide an insertion opening large enough to permit insertion of the flexible tube and an operational position in which the insertion opening is closed. In preferred embodiments the cover has a lip that extends over the region adjacent to the tube so as to block the tube from leaving the region between the rotor and race during operation; there is a lifter mounted on the cover that helps pull the tube outward; and the cover has a faceplate that is pivotally and lockably mounted to permit access to the rotor.

In still another aspect, the invention features self-loading a flexible tube in a peristaltic pump by using rollers with small diameter portions at the upper ends adjacent to larger diameter central portions, to cause the tube to be pulled toward the larger diameter portions.

Other advantages and features of the invention will be apparent from the following description of the preferred embodiment thereof and from the claims.

DESCRIPTION OF THE PREFERRED EMBODIMENT

The drawings will be described first.

Drawings

FIG. 1 is an elevation of a peristaltic pump according to the invention shown with a disposable fluid chamber cassette carrying a U-shaped flexible tube used in the pump.

FIG. 2 is a bottom view showing the driving mechanism for the FIG. 1 pump.

FIG. 3 is a partial, horizontal sectional view, taken at 3—3 of FIG. 1, showing a roller, the facing race and associated parts of the FIG. 1 pump.

FIGS. 6 and 7 are side elevations, taken at 7—7 of FIG. 1, showing the cover of the FIG. 1 apparatus in different positions.

STRUCTURE

Figure 4:
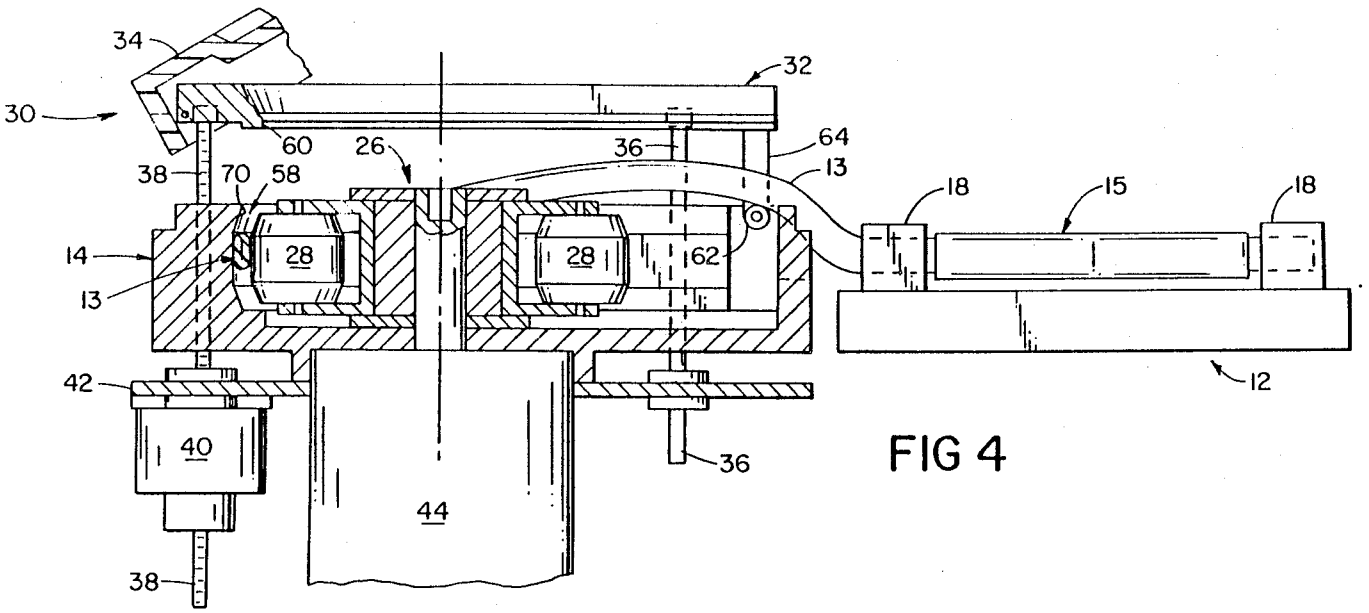
FIGS. 4 and 5 are horizontal sectional views, taken at 5—5 of FIG. 1, showing the cover of the FIG. 1 apparatus in different positions.

Referring to FIG. 1, there is shown peristaltic pump 10 mounted on the front of a dialysate preparation machine (only front support plate 12 is shown) in a position to receive flexible tube 13 of disposable fluid chamber cassette 15, mounted next to pump 10 on front plate 12 by jaws 18. Pump 10 includes race 14 having internal surface 16 defining a half of a circle and straight tangential portions 22, 24 leading to it. Wall 17 has slots 19 through which tube 13 passes. Pump rotor 26 carries rollers 28 on roller supports 29, which are pivotally mounted at one end and spring-biased radially outward at the other end. Covering race 14 and rotor 26 is movable cover 30, which includes generally U-shaped tube guide 32 and lockable clear plastic cover 34 pivotally mounted thereon.

Referring to FIGS. 1, 2, 6 and 7 it is seen that tube guide 32 of cover 30 is slidably mounted on guide shafts 36 and connected to threaded shaft 38, which is displaceable along its longitudinal axis by stepper motor 40, mounted on support plate 42. Rotor motor 44 is also shown in FIGS. 2, 6 and 7.

Referring to FIG. 3, it is seen that roller 28 (acetal with 20% TFE content, Delrin AF) has large diameter central portion 46 (0.955"), and conical small diameter portions 48, which each are at a 10° angle and end at a face having a 0.889" diameter. Internal surface 16 of side wall 50 has a similar large diameter portion 52 aligned with large diameter portion 46 of roller 28 and adjacent angled small diameter portions 54 aligned with conical portions 48 of roller 28. Tube 13 is occluded in tube-pumping region 56 between roller 28 and internal surface 16. Outward of tube-pumping region 56 is tube mounting region 58, which is occupied by lip 60 of tube guide 32 when in the operational position shown in FIG. 3.

Referring to FIG. 4, it is seen that tube guide 32 includes lifter 62, which is a roller supported on arm 64, carried by tube guide 32.

Operation

In operation, at the beginning of use with a new patient, cover 30 is moved to the loading position shown in FIG. 6, though plastic cover 34, not open during normal operation, would be closed. Cassette 15 is moved by the operator in front of jaws 18 in position for engagement by them; at the same time, tube loop 13 is moved through tube insertion opening 66 and placed in tube mounting region 58.

Pump 10 automatically loads tube loop 13 by actuating stepper motor 40 to pull threaded shaft 38 inward, causing tube guide 32 to move toward race 14 at the same time that rotor 26 rotates counterclockwise. The action of rollers 28 on tube 13 in tube mounting region 58 causes tube 13 to be pulled into tube-pumping region 56. The increasing radius of conical portion 48 causes tube 13 to be moved to large central diameter portion 46. As tube guide 32 continues moving toward race 14, lip 60 partially occupies and blocks tube mounting region 58, preventing tube 13 from returning to it. In the operating position (FIG. 7), cover 34 completely covers the region around rotor 26.

During pumping operation, tube 13 maintains proper alignment at central portion 46, because if the tube tends to travel to the smaller diameter portions, it is directed back to the large diameter portion owing to the differences in linear velocity of the surface of the roller from the edge to the crown. Because internal surface 16 of race 14 similarly has matching small diameter conical portions 54, in the event that tube 13 does temporarily move off of the large diameter portion, it is prevented from becoming unoccluded and permitting fluid flow past the roller.

Figure 5:
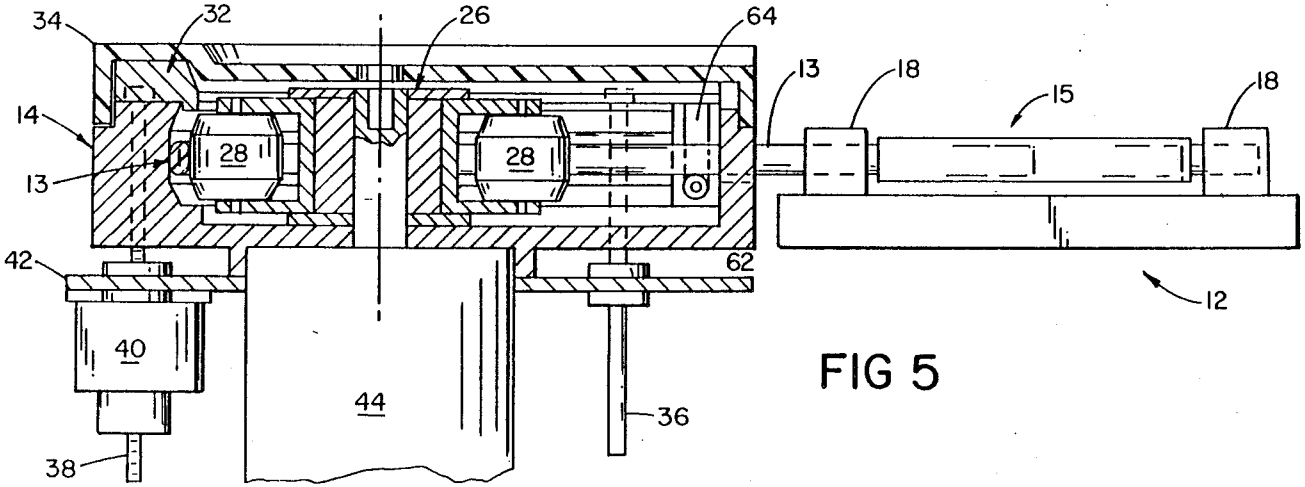

When cassette 15 and tube 13 are to be removed, stepper motor 40 is actuated, causing tube guide 32 to move outward. At the same time, lifter 62, connected to tube guide 32 and moving from the FIG. 5 postion to the FIG. 4 position, lifts the leading portion of tube 13 outward beyond rollers 28 into tube mounting region 58 as they continue to rotate counterclockwise. When tube guide 32 is in the position shown in FIG. 6, tube 13 is free to move outward through insertion opening 66 when cassette 15 is removed from the machine by the operator.

In the loading position, there is only a very small opening to the tube mounting region around the rotor, reducing the possibility that an operator might accidentally stick his or her fingers into the region of the moving parts during the loading operation. Because of the self-aligning feature, caused solely by of the shape of roller 28, there is no need to use guide surfaces to direct the tube to the proper position, and thus there is reduced friction associated with alignment, providing for reduced wear and increased life of tube 13 and of cassette 15, which is reusable.

Other Embodiments

Other embodiments are within the scope of the following claims.

What is claimed is:

1. A peristaltic pump comprising a rotor rotatably mounted about a rotor axis and carrying rotor rollers that travel in a circular path, a race with an internal surface for supporting a flexible tube in a tube pumping region between it and said circular path, said surface including points that are at equal radii from said rotor axis in planes perpendicular to said rotor axis, a cover mounted on said race for movement in a direction parallel to said rotor axis between a loading position spaced from said race sufficiently to permit insertion of said tube through a tube insertion opening into a tube mounting position adjacent to said tube pumping region and an operational position in which said tube insertion opening is closed, and a lifter to move said tube in a direction parallel to said rotor axis and away from said rotor rollers as said cover is moved from said operational position to said loading position.

2. The pump of claim 1 wherein said internal surface extends beyond said rotor in a direction parallel to said rotor axis so as to partially define said tube mounting region, said cover has a lip that extends over said tube mounting region when in said loading position and is located in said tube mounting region when in said operational position so as to prevent said tube from moving from said tube pumping region to said tube mounting region when said cover is in said operational position.

3. The pump of claim 1 wherein said lifter is a lifter roller mounted on said cover such that said lifter roller is below said rotor rollers when in said operational position and moves through a region at the same location along axes parallel to said rotor axis as said rotor rollers when moving from said operational position to said loading position.

4. The pump of claim 1 further comprising means for moving said cover parallel to said rotation axis between said loading position and said operational position.

5. The pump of claim 4 wherein said means for moving comprises a stepping motor driving a linearly displaceable drive shaft connected to said cover, and said cover is slidably mounted with respect to said race via guide shafts.

6. The pump of claim 2 wherein said cover has a surface that extends in the direction of travel of said cover and overhangs a portion of said race when in said operational position.

7. The pump of claim 6 wherein said cover includes a pivotally mounted lockable faceplate that overlies said rotor and said tube pumping region.

8. The pump of claim 6 further comprising a wall mounted adjacent to said rotor and having two slots therethrough for receiving said tube, the openings to said slots being covered by said cover when in said operational position and being opened when in said loading position.

9. A peristaltic pump comprising a support, a rotor rotatably mounted on said support about a rotor axis and carrying rotor rollers that travel in a circular path, and a race with an internal surface defining a portion of a circle for supporting a removable flexible tube in a tube pumping region between it and said circular path, said surface including points that are at equal radii from said rotor axis in planes that are perpendicular to said rotor axis, said race being fixedly mounted on said support, said internal surface of said race being spaced from said rollers so as to provide a tube mounting region adjacent to said tube pumping region in a direction parallel to said tube rotor axis, there being a sufficiently open region between said tube mounting region and said pumping region to permit travel between the two of said tube, said rollers having a small diameter portion at an end adjacent to said tube mounting region and a large diameter portion adjacent to said small diameter portion to cause said tube to be self-loaded, during rotation of said rotor, from said tube mounting region to said tube pumping region, owing to the action of the difference in radius of the rollers.

10. The pump of claim 9 further comprising a cover mounted on said race for movement in a direction parallel to said rotor axis between a loading position spaced from said race sufficiently to permit insertion of said tube through a tube insertion opening into said tube mounting region and an operational position in which said tube insertion opening is closed, and wherein said cover has a lip that extends over said tube mounting region when in said loading position and is located in said tube mounting region when in said operational position so as to prevent said tube from moving from said tube pumping region to said tube mounting region when said cover is in said operational position.

11. The pump of claim 10 further comprising a lifter to move said tube in a direction parallel to said rotor axis and away from said rotor rollers as said cover is moved from said operational position to said loading position.

12. The pump of claim 11 wherein said lifter is a lifter roller mounted on said cover such that said lifter roller is below said rotor rollers when in said operational position and moves through a region at the same location along axes parallel to said rotor axis as said rotor rollers when moving from said operational position to said loading position.

13. The pump of claim 10 further comprising means for moving said cover parallel to said rotation axis between said loading position and said operational position.

14. The pump of claim 13 wherein said means for moving comprises a stepping motor driving a linearly displaceable drive shaft connected to said cover, and said cover is slidably mounted with respect to said race via guide shafts.

15. The pump of claim 10 wherein said cover has a surface that extends in the direction of travel of said cover and overhangs a portion of said race when in said operational position.

16. The pump of claim 15 wherein said cover includes a pivotally mounted lockable faceplate that overlies said rotor and said tube pumping region.

* * * * *